United States Patent [19]

Haerer

[11] 4,443,001

[45] Apr. 17, 1984

[54] HYDRAULICALLY OPERATED HAND TOOL FOR FORCING OPEN DOORS

[76] Inventor: James P. Haerer, P.O. Box 134, Dunkirk, Md. 20754

[21] Appl. No.: 379,918

[22] Filed: May 19, 1982

[51] Int. Cl.[3] ..... B66F 3/24

[52] U.S. Cl. ..... 254/93 R; 29/239

[58] Field of Search ..... 29/239, 275, 252; 254/93 R, 93 H, 133; 269/252

[56] References Cited

U.S. PATENT DOCUMENTS

| | | | |
|---|---|---|---|
| 2,283,089 | 5/1942 | Pfauser . | |
| 2,947,275 | 8/1960 | Edmonds | 254/93 R |
| 3,081,066 | 3/1963 | Murawski | 29/239 |
| 3,426,752 | 2/1969 | Laico | 29/239 |
| 3,649,975 | 3/1972 | Spurgeon . | |
| 3,662,994 | 5/1972 | Johns | 254/93 R |
| 3,705,581 | 12/1972 | Drake | 29/239 |
| 3,762,688 | 10/1973 | Leonhardt . | |
| 3,891,187 | 6/1975 | Bearden . | |
| 3,946,988 | 3/1976 | Kehren | 254/93 R |
| 4,197,706 | 4/1980 | Blake | 29/239 |

*Primary Examiner*—Robert C. Watson

*Attorney, Agent, or Firm*—Donald A. Kettlestrings

[57] ABSTRACT

A hand tool, for use with a hydraulic pump, for forcing or prying open doors and other objects. First and second jaw members, each having spaced apart fingers, are connected together by a hydraulic piston-cylinder assembly which is adapted for hydraulic connection to the hydraulic pump. The spaced apart fingers of the jaw members mesh with each other when the jaw members are positioned together. A plate member defining opposed sides is connected to the first jaw member and the second jaw member defines first and second guide members with each of the guide members projecting adjacent respective sides of the plate member and in slidable relationship with the plate member. A third guide member extends from the plate member and encircles a portion of the piston-cylinder assembly in slidable relationship with the assembly.

12 Claims, 6 Drawing Figures

Fig. 1.
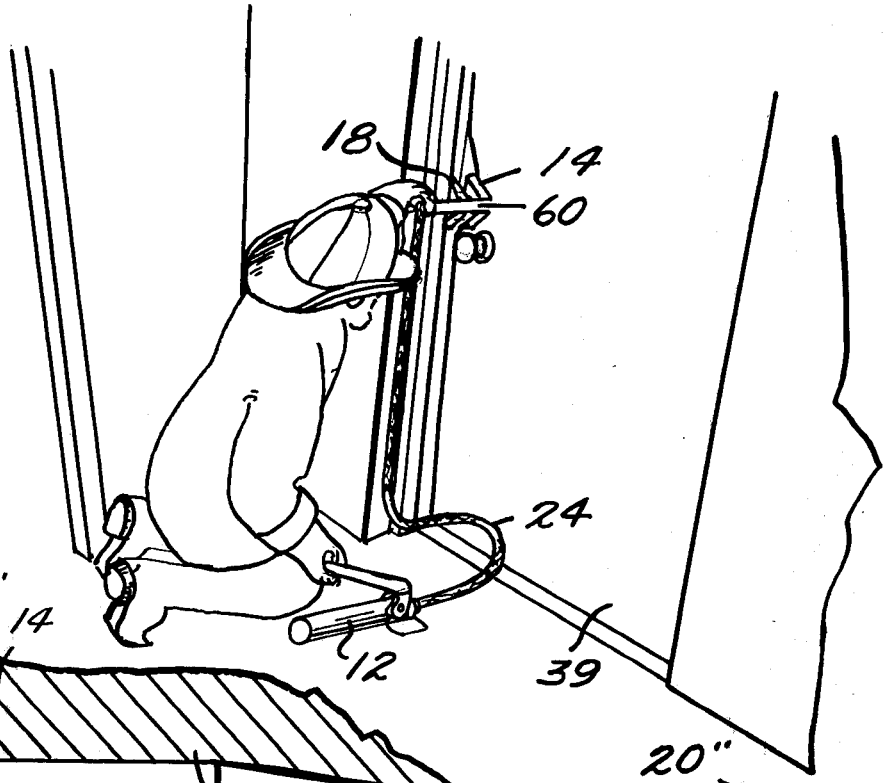
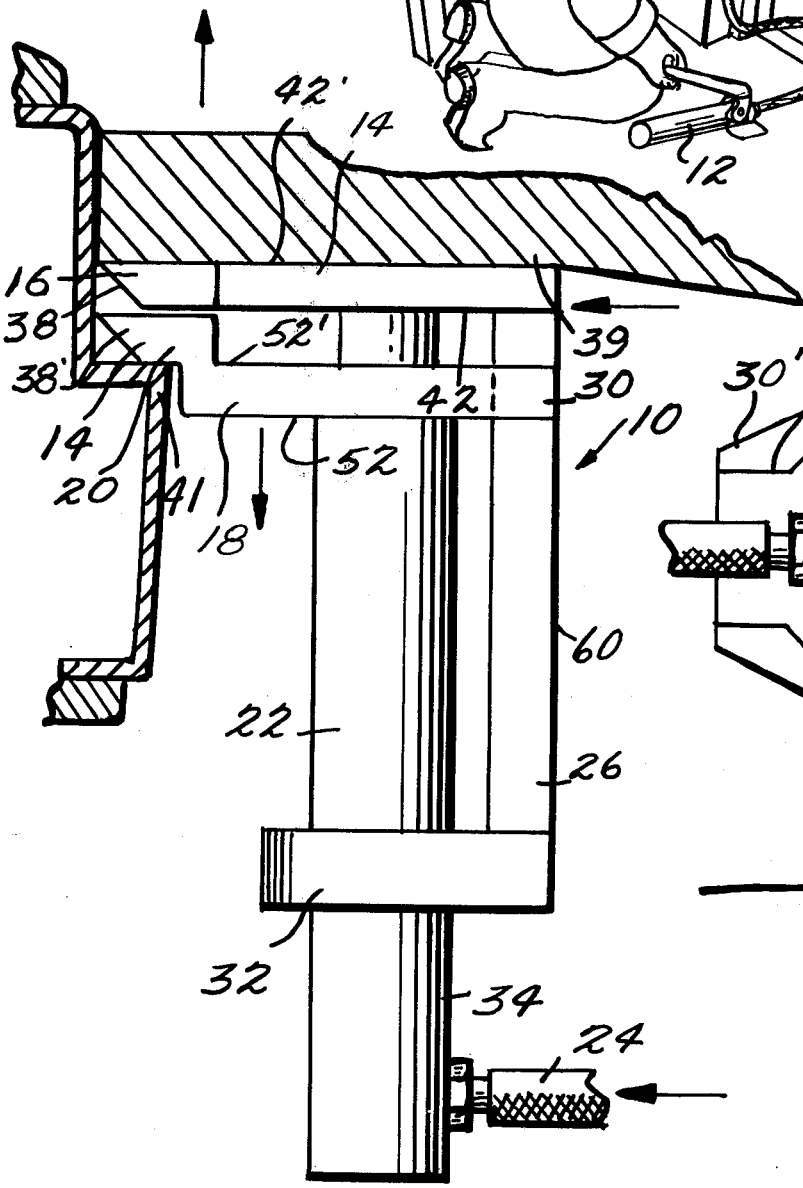
Fig. 2.
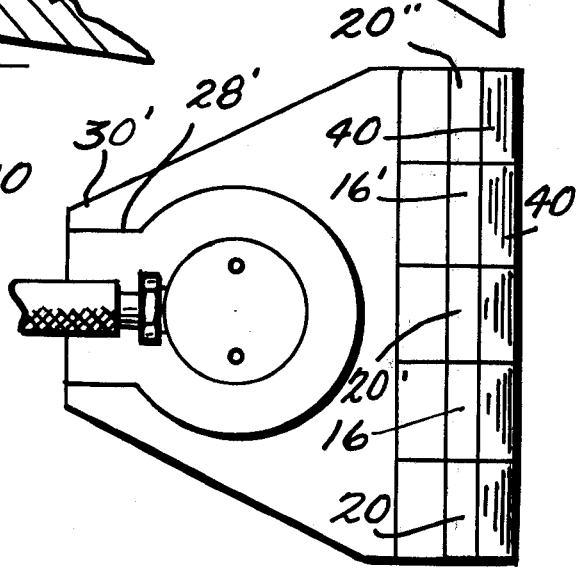
Fig. 3.

HYDRAULICALLY OPERATED HAND TOOL FOR FORCING OPEN DOORS

This invention relates to a hydraulically operated hand tool and more particularly to such a tool for forcing or prying open doors and other objects.

Various devices have been developed in the past for use by firemen and rescue personnel in forcing open doors and for prying open other objects. Although such devices have served the purpose, they have not proved entirely satisfactory under all conditions of service.

It is, therefore, an object of the present invention to provide a hydraulically operated hand tool for forcing or prying open doors and other objects.

Another object is to provide such a tool which is stable and safe during operation.

A further object of the invention is the provision of such a hand tool which enables the safe and rapid application of large amounts of force.

Still another object is to provide such a hydraulically operated hand tool which is provided with a plurality of fingers having wedge-shaped edge portions for enabling the fingers to be driven into the space between a door and the door jam.

A still further object of the invention is the provision of such a tool which provides a large amount of surface area to contact the door and the door jam during the opening or prying operation.

Yet another object of the present invention is the provision of such a hand tool which is provided with guide elements for safely stabilizing the tool during operation.

Additional objects and advantages of the invention will be set forth in part in the description that follows and in part will be obvious from the description, or may be learned by practice of the invention. The objects and advantages are realized and attained by means of the instrumentalities and combinations particularly pointed out in the appended claims.

To achieve these and other objects, the present invention provides a tool, for use with a hydraulic pump, for forcing or prying open doors and other objects, the tool comprising: a first jaw member defining at least two spaced apart fingers; a second jaw member defining at least three spaced apart fingers positioned and shaped to selectively mesh with the fingers of the first jaw member when the jaw members are positioned together; a hydraulic piston-cylinder assembly adapted for hydraulic connection to the pump and connected to the first and second jaw members; a plate member defining opposed sides, the plate member connected to the first jaw member; the second jaw member further defining first and second guide members with each of the guide members projecting adjacent respective sides of the plate member and in slidable relationship with the plate member; and a third guide member extending from the plate member and encircling a portion of the piston-cylinder assembly in slidable relationship with the assembly.

In accordance with the invention, the piston-cylinder assembly preferably includes an outer casing and a piston-piston rod assembly slidable within the casing, and wherein the outer casing is connected to the second jaw member and the piston-piston rod assembly is connected to the first jaw member.

Preferably, each of the fingers defines a wedge-shaped edge portion for enabling forcible introduction of the fingers between a door and the door jam. The wedge-shaped edge portions are aligned with each other to form a substantially continuous wedge-shaped edge portion when the first and second jaw members are positioned together and the fingers are intermeshed.

It is to be understood that both the foregoing general description and the following detailed description are exemplary and explanatory but are not restrictive of the invention.

The accompanying drawings, which are incorporated in and constitute a part of the specification, illustrate an example of a preferred embodiment of the invention and, together with the description, serve to explain the principles of the invention.

FIG. 1 is a pictorial view illustrating the tool in use by a fireman forcing open a door;

FIG. 2 is a fragmentary top plan view of the tool and showing it inserted between a door and the door jam with the jaws in an opened position;

FIG. 3 is a top plan view of the tool as it would be positioned when resting on a horizontal supporting surface when not in use;

Figure 4:
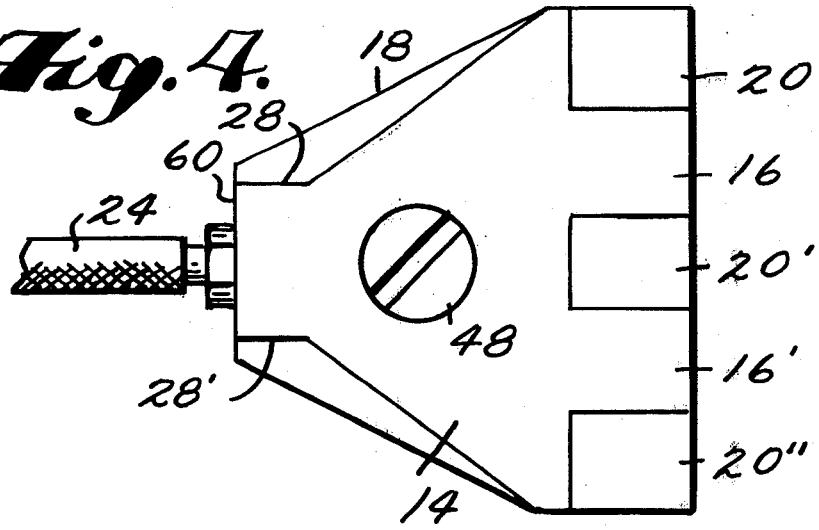
FIG. 4 is a bottom plan view of the tool as depicted in FIG. 3.
Figure 5:
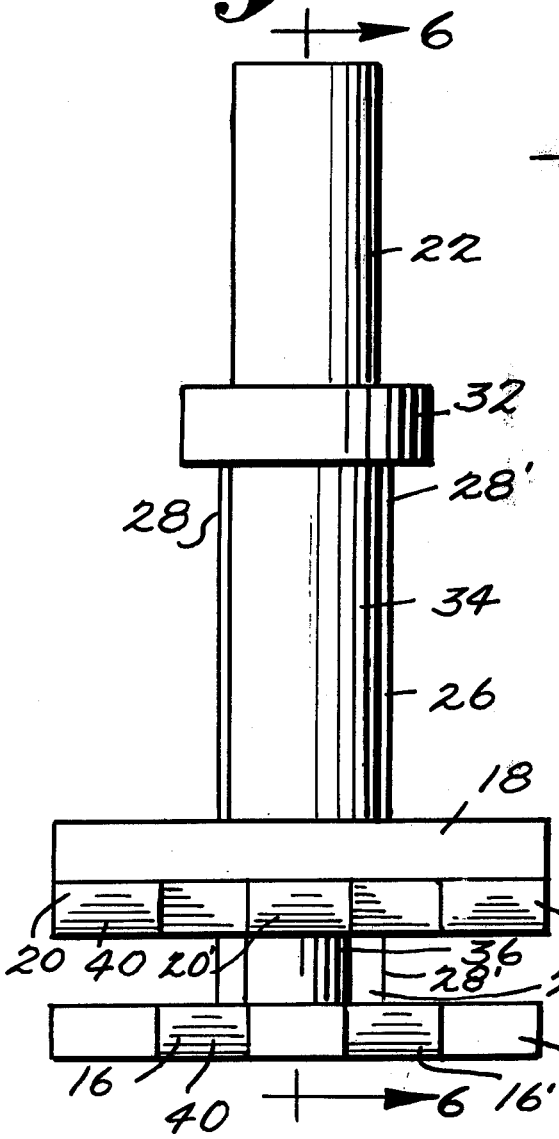
FIG. 5 is a front elevation view of the tool as depicted in FIG. 3 and showing the jaws in an opened position.

With reference now to the drawings, wherein like reference characters designate like or corresponding parts throughout the several views, there is shown a tool 10 in accordance with the invention for use with a conventional hydraulic pump 12.

A first jaw member 14 defines at least two spaced apart fingers 16, 16'. A second jaw member 18 defines at least three spaced apart fingers 20,20',20'' positioned and shaped to selectively mesh with fingers 16, 16' when the jaw members are positioned together. A hydraulic piston-cylinder assembly 22 is connected to hydraulic pump 12 by means of connecting line 24, and assembly 22 is rigidly connected to jaw members 14, 18. A plate member 26, defining opposed sides 28, 28', is connected to first jaw member 14. Second jaw member 18 defines first and second guide members 30, 30', and each of guidemembers 30, 30' projects adjacent respective sides 28, 28' of plate member 26 and in slidable relationship with sides 28, 28'.

A third guide member 32 extends from plate member 26 and encircles a portion of cylinder assembly 22, in slidable relationship with the assembly. Piston-cylinder assembly 22 includes an outer casing 34 and a piston-piston rod assembly 36 slidable within casing 34. Casing 34 is connected to second jaw member 18, and assembly 36 is connected to first jaw member 14.

Figure 6:
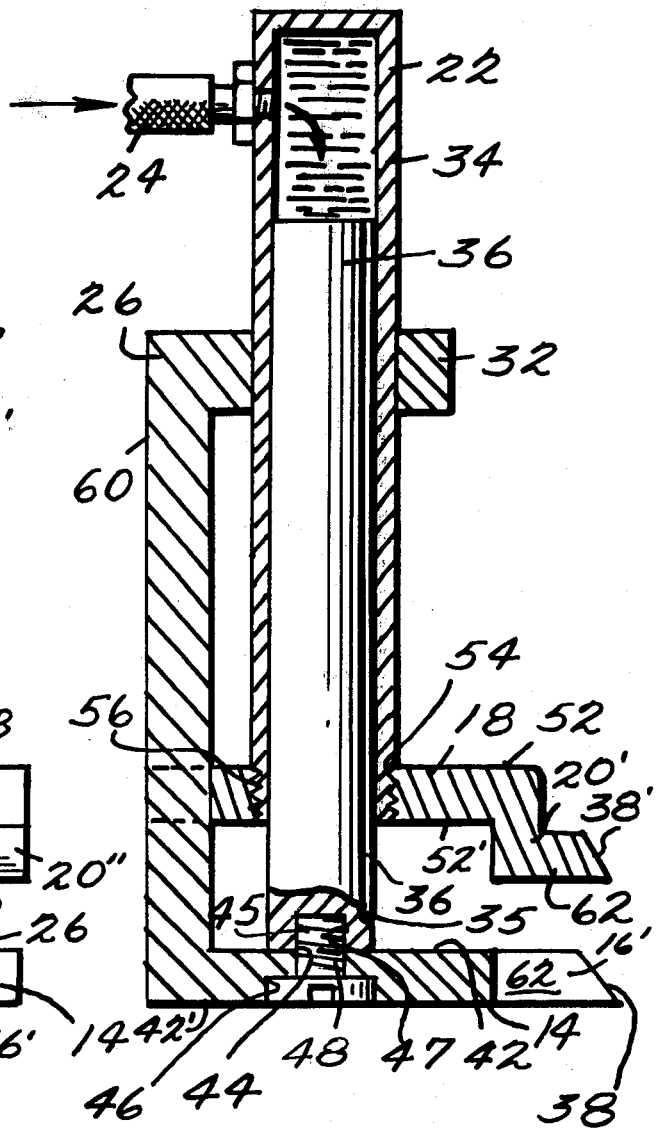
FIG. 6 is a vertical section view of the tool taken along the line 6—6 in FIG. 5 and looking in the direction of the arrows.

Each of fingers 16, 16' defines a wedge-shaped edge portion 38, and each of fingers 20, 20', 20'' defines a similar wedge-shaped edge portion 38' for enabling forcible introduction of the fingers between a door 39 and the door jam 41. Wedge-shaped edge portions 38, 38' are aligned with each other to form a substantially continuous wedge-shaped edge portion when jaw members 14, 18 are postioned together and when fingers 16, 16' and 20, 20',20'' are intermeshed. Each of fingers 20, 20', 20'' is substantially L-shaped (FIGS. 2 and 6) for enabling fingers 20, 20', 20'' to intermesh with fingers 16, 16' when jaw members 14,18 are positioned together.

Each of fingers 16, 16' and 20, 20', 20'' defines a plurality of substantially parallel grooves 40 extending across each finger for gripping into the metal or other material of the door jam or other object and for holding the fingers in place until the door or other object is opened.

First jaw member 14 defines first and second substantially flat and parallel surfaces 42, 42'. First surface 42 defines a first opening 44 (FIG. 6) which receives a threaded shaft 45 of flat headed screw 48. Exterior end 35 of piston rod 36 also defines a second threaded opening 47 for receiving threaded shaft 45 of screw 48. Second surface 42' defines a third countersunk opening 46 in alignment and communication with first opening 44. Flat headed screw 48 is threadedly engaged with opening 47 and is positioned within openings 44,46.

Second jaw member 18 defines third and fourth substantially flat and parallel surfaces 52, 52'. Surfaces 52, 52' define a fourth threaded opening 54, which extends through jaw member 18, and a threaded end 56 of casing 34 is threadedly engaged with and received by opening 54.

Plate member 26 defines a substantially flat plate surface 60 extending between sides 28, 28' of the plate member, and surface 60 acts as a striking surface for receiving blows from a sledge hammer or other object (not shown) when forcing fingers 16, 16' and 20, 20', 20'' between door 39 and door jam 41.

Each of fingers 16, 16' and 20, 20', 20'' are of substantially uniform width for providing the maximum amount of surface area contact with the door and door jam. Each of the fingers also preferably defines portion 62 of substantially uniform depth for providing the maximum amount of strength to the fingers.

In operation, a shoulder strap (not shown) can be attached to hydraulic pump 12 to enable the fireman or rescue person to carry the tool. In its normally closed condition tool 10 is positioned with first surface 42 of jaw member 14 in contacting relationship with fourth surface 52' of jaw member 18. Fingers 16, 16' and 20, 20', 20'' are intermeshed, and wedge-shaped edge portions 38, 38' are substantially aligned with each other to form a substantially continuous wedge-shaped edge portion.

When the tool is to be used to force open a door, wedge-shaped edge portions 38, 38' of the fingers are forced between door 39 and door jam 41. Fingers 16, 16' and 20, 20', 20'' are then forced further into the space between the door and door jam by hand or by striking plate surface 60 with a tool, such as a flat head axe, Haligan bar, or hammer (not shown).

The tool operator holds tool 10 in position (FIG. 1) by grasping casing 34 with one hand, and hydraulic pump 12 can be operated with the other hand to cause jaw members 14, 18 to separate. As hydraulic pump 12 is operated, piston-piston rod assembly 36 moves within casing 34. This causes movement of first jaw member 14 away from second jaw member 18, and plate member 26 together with guide member 32 move with first jaw member 14.

Second jaw member 18 remains in fixed position and attached to casing 34. As the jaw members separate, forces are applied against door 39 by fingers 16, 16' and by second surface 42' of jaw member 14. Simultaneously, opposing forces are applied to door jam 41 by fingers 20, 20',20''. As jaws 14, 18 separate, movement of the jaws is guided by means of guide members 30, 30' and by guide member 32. Extremely large forces are applied to the door, the door jam and to the tool, and cocking of the tool and misalignment of the jaw members under such large forces are prevented by means of guides 30, 30' and 32.

As jaws 14, 18 separate and forces are applied to the door and to the door jam, guide member 32 slides downwardly along casing 34. This has the effect of maintaining first jaw member 14 in proper position and keeps piston 36 straight and true within casing 34. Guide 32 also avoids kick-back of tool 10 against the door jam and holds jaw member 14 flat against the door to provide a greater surface area for the application of force to the door. Guides 30, 30' slide upwardly along opposed sides 28, 28' by plate member 26 as the jaws separate, and this maintains the jaw members in proper relative positions with respect to each other.

When the door or other object has been opened, hydraulic pump 12 is operated in a conventional manner to release the hydraulic pressure within piston-cylinder assembly 22. Jaw member 14 can then be manually pushed toward jaw member 18 so that piston-rod 36 reenters casing 34. Guide members 30, 30' and 32 maintain the proper relative positions of the jaw members as they are moved together so that fingers 16, 16' and 20, 20', 20'' mesh properly when the jaw members are repositioned together.

This invention provides for a hydraulically operated hand tool which can be easily carried by use of a shoulder strap. Tool 10 can be carried by hand or in a coat pocket so as to free the user's hands for other tasks when the tool is not in use. Even metal doors with several locks can be quickly opened by use of the tool, and a tool twelve inches high can exert pressures as high as 8600 psi on doors to be opened. Experience has shown that six strokes of a conventional hydraulic pump 12 causes jaw members 14, 18 to open one and one-half inches.

The invention in its broader aspects is not limited to the specific details shown and described, and departures may be made from such details without departing from the principles of the invention and without sacrificing its chief advantages.

What is claimed is:

1. A tool, for use with a hydraulic pump, for forcing or prying open doors and other objects, said tool comprising:

a first jaw member defining at least two spaced apart fingers;

a second jaw member defining at least three spaced apart fingers positioned and shaped to selectively mesh with said fingers of said first jaw member when said jaw members are positioned together;

a hydraulic piston-cylinder assembly for hydraulic connection to said pump and connected to said first and second jaw members;

a plate member defining opposed sides, said plate member connected to said first jaw member;

said second jaw member further defining first and second guide members, each of said guide members projecting adjacent respective sides of said plate member and in a slidable relationship with said plate member; and a third guide member extending from said plate member and encircling a portion of said piston-cylinder assembly in slidable relationship with said assembly.

2. A tool as in claim 1 wherein said piston-cylinder assembly includes an outer casing and a piston-piston rod assembly slidable within said casing, and wherein said outer casing is connected to said second jaw member, and said piston-piston rod assembly is connected to said first jaw member.

3. A tool as in claim 2 wherein each of said fingers defines a wedge-shaped edge portion for enabling forcible introduction of said fingers between a door and the door jam.

4. A tool as in claim 3 wherein said wedge-shaped edge portions are aligned with each other to form a substantially continuous wedge-shaped edge portion when said first and second jaw members are positioned together and said fingers are intermeshed.

5. A tool as in claim 4 wherein each of said fingers of said second jaw member is substantially L-shaped.

6. A tool as in claim 5 wherein each of said fingers defines a plurality of substantially parallel grooves extending across each finger.

7. A tool as in claim 6 wherein said first jaw member defines first and second substantially flat, parallel surfaces, said first surface defining a first opening, an exterior end of said piston rod defining a second threaded opening, and said second surface defining a third countersunk opening in alignment and communication with said first opening, and a flat headed screw threadedly engaged with said second threaded opening and positioned within said first opening and said countersunk opening.

8. A tool as in claim 7 wherein said second jaw member defines third and fourth substantially flat, parallel surfaces, said third and fourth surfaces defining a fourth threaded opening extending through said second jaw member, said casing defining a threaded end, and said fourth threaded opening threadedly receiving said threaded end of said casing.

9. A tool as in claim 8 wherein said plate member defines a substantially flat plate surface extending between said sides of said plate member for acting as a striking surface.

10. A tool as in claim 9 wherein said first and fourth surfaces of said jaw members are in contacting relationship with each other when said jaw members are positioned together.

11. A tool as in claim 10 wherein said fingers are each of substantially uniform width for providing the maximum amount of surface area contact with the door and the door jam.

12. A tool as in claim 11 wherein said fingers each define portions of substantially uniform depth for providing the maximum amount of strength to said fingers.

* * * * *